US005615418A

United States Patent [19]

Pruit

[11] Patent Number: 5,615,418

[45] Date of Patent: Apr. 1, 1997

[54] LOW-FRICTION INSERT

[76] Inventor: John D. Pruit, 2929 Miracle La., Flower Mound, Tex. 75028

[21] Appl. No.: 447,084

[22] Filed: May 22, 1995

[51] Int. Cl.[6] ..... A41B 11/00

[52] U.S. Cl. ..... 2/239; 2/46

[58] Field of Search ..... 2/239, 409, 1, 2/46; 36/102, 113–116, 11, 9 R, 10, 26

[56] References Cited

U.S. PATENT DOCUMENTS 4,708,272 11/1987 Guerra ..... 2/239

*Primary Examiner*—C. D. Crowder
*Assistant Examiner*—Gloria Hale
*Attorney, Agent, or Firm*—Baker & Botts, L.L.P.

[57] ABSTRACT

An article of footwear (10) is provided that comprises an inner layer of material (14) that is worn next to the skin of a user (12). A friction isolation layer (16) is disposed outwardly from the inner layer (14). An outer layer (20) is disposed outwardly from the inner layer (14) and the friction isolation layer (16). Movement of the outer layer (20) is not translated to the inner layer (14) due to the positioning of friction isolation layer (16) between the inner layer (14) and the outer layer (20).

24 Claims, 1 Drawing Sheet

LOW-FRICTION INSERT

TECHNICAL FIELD OF THE INVENTION

This invention relates in general to the field of clothing, and more particularly to a low-friction insert.

BACKGROUND OF THE INVENTION

There is a wide variety of garments that are designed to provide comfort to people engaged in strenuous activities such as running and skiing. Various garment materials heat and cool the feet and reduce irritation to the feet while worn. These garments, however, do not completely prevent discomfort to the feet of the wearer as a result of repetitive external movement of the garments against the skin of the foot and lower leg.

For example, a common occurrence causing discomfort in snow skiing results when the skier is subjected to irritation or chafing of the skin around the lower leg inside of the ski boot. The higher the quality and the better the fit of the ski boot reduces the pressure applied to the specific locations of the foot or leg of the skier. This lessens the discomfort felt by the skier due to the direct pressure of the boot against the skin. No matter how high the quality of the boot, however, discomfort may result from the twisting motion of the boot as it causes the skier's sock to rub against the skin of the skier while skiing. This twisting motion, may be transferred to the sock that, in turn, rubs against the skier's lower leg and ankle, which may irritate the skier's skin. This problem still exists even when multiple socks are worn because the socks still translate the boot's twisting motion to the skin of the skier's leg, which may irritate the skier's skin.

Accordingly, a need has arisen for a low-friction insert that eliminates irritation to the skin of the foot, ankle, and lower leg of a person subjected to strenuous repetitive motion.

SUMMARY OF THE INVENTION

In accordance to the teachings of the present invention, a low friction insert is provided that substantially reduces or eliminates disadvantages and problems associated with prior solutions.

According to one embodiment of the present invention, an article of footwear is provided that comprises an inner fabric layer formed so that it may be disposed adjacent the skin of the user. A friction isolation layer is formed outwardly from at least portions of the inner layer. An outer layer of material is formed surrounding the frictionless isolation material and the inner layer of material such that movement of the outer layer of material is not translated to the inner layer of material because of the positioning of the friction isolation layer between the two inner and outer layers.

One aspect of the present invention provides an article of clothing. The article includes an outer layer of fabric and inner layer of fabric disposed within the outer layer and adjacent the skin of the user of the clothing. The clothing also includes a friction isolation surface disposed between the inner layer and the outer layer such that substantially all movement of the outer layer is not translated to movement of the inner layer relative to the skin of the user of the clothing.

Another aspect of the present invention provides an insert for use between an outer layer of fabric and an inner layer fabric, the inner layer disposed adjacent the skin of the user. The insert includes a sheet of friction isolation material disposed between the inner and outer layer for isolating movement of the outer layer with respect to the inner layer so that substantially all movement of the outer layer is not translated to movement of the inner layer relative to the skin of the user of the article.

Yet another aspect of the present invention provides a method for reducing a person's skin irritation due to repetitive motion of an article against the person's skin. The method includes placing a first layer of fabric outwardly from the person's skin and placing a second layer of fabric outwardly from the first layer. The method also includes placing a friction isolation surface between the first and second layers such that substantially all movement of the outer layer is not translated to movement of the inner layer relative to the person's skin.

The present invention provides a technical advantage of minimizing irritation to a person's skin while using the present inventive insert.

Another technical advantage of the present invention is that it may be used to provide comfort to its user during various activities from skiing to horseback riding.

Yet another technical advantage of the present invention is that it may be formed from commercially available materials, and therefore, has relative low-cost.

Another technical advantage of the present invention is that it is light-weight and may be used with a person's existing equipment, e.g., ski boots or shoes.

Another technical advantage of the present insert is that with its use, the user can enjoy extended periods of activity without skin irritation.

BRIEF DESCRIPTION OF THE DRAWINGS

For a more complete understanding of the present invention and advantages thereof, reference is now made to the following description taken in conjunction with the accompanying drawings in which like reference numbers indicate like features, and wherein.

DETAILED DESCRIPTION OF THE INVENTION

Figure 1:
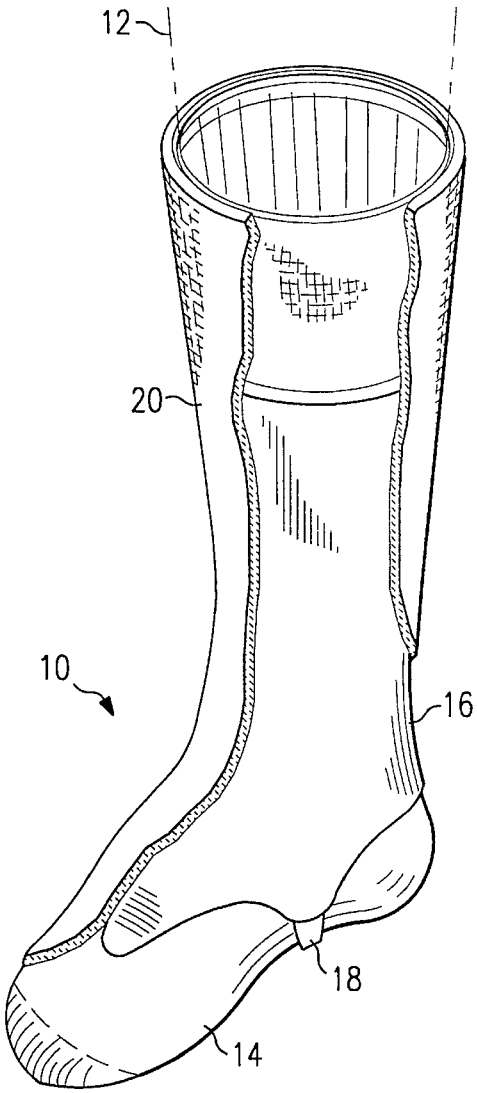
FIG. 1 is an illustration of one embodiment of low-friction footwear constructed according to the teachings of the present invention.

FIG. 1 illustrates the components of an article of low friction footwear indicated generally at 10 that covers the lower leg, ankle, and foot of user 12. Footwear 10 comprises inner layer 14 of material which fits closely around the foot of user 12. Footwear 10 further comprises friction isolation layer 16 that is disposed outwardly from inner layer 14. Friction isolation layer 16 may cover portions of inner layer 14 or the entirety of inner layer 14. As shown in FIG. 1, friction isolation layer 14 covers the upper portions of the ankle of user 12 and the lower calf of user 12. In the case where friction isolation layer 16 covers only a portion of inner layer 14 as shown in FIG. 1, friction isolation layer 16 may be held securely in place by retention strap 18 that passes underneath the foot of user 12 to secure friction isolation layer 16 in place.

Finally, footwear 10 comprises outer layer 20 of material that completely surrounds inner layer 14 and friction isolation layer 16. Outer layer 20 comes in contact with any shoe or boot worn by user 12. The movement of the shoe or boot would ordinarily cause a conventional sock to rub against the skin of the user 12. Due to the positioning of friction isolation layer 16 between inner layer 14 and outer layer 20, the movement of a shoe or boot around outer layer 20 causes outer layer 20 to move, but this movement of outer layer 20 is not translated to inner layer 14 that is disposed against the skin of user 12. In a similar way, friction isolation layer 16 may be placed directly against a person's skin.

Inner layer 14 and outer layer 20 may comprise conventional fabrics used to provide comfortable and durable socks, such as cotton, nylon, wool, or the like, and may also provide additional thermal insulation to the wearer. Friction isolation layer 16 may comprise a wide variety of materials that provide a reduced or low-friction surface. For example, friction isolation layer 16 may comprise slick vinyl, satin cloth, mylar, plastic sheets, slick nylon, or any other material that will prevent the translation of movement of outer layer 20 to inner layer 14. Additionally, it may be desirable to form friction isolation layer 16 of a water proof or water resistant material. Also, friction isolation layer 16 may be used with more than two layers of material.

Figure 2:
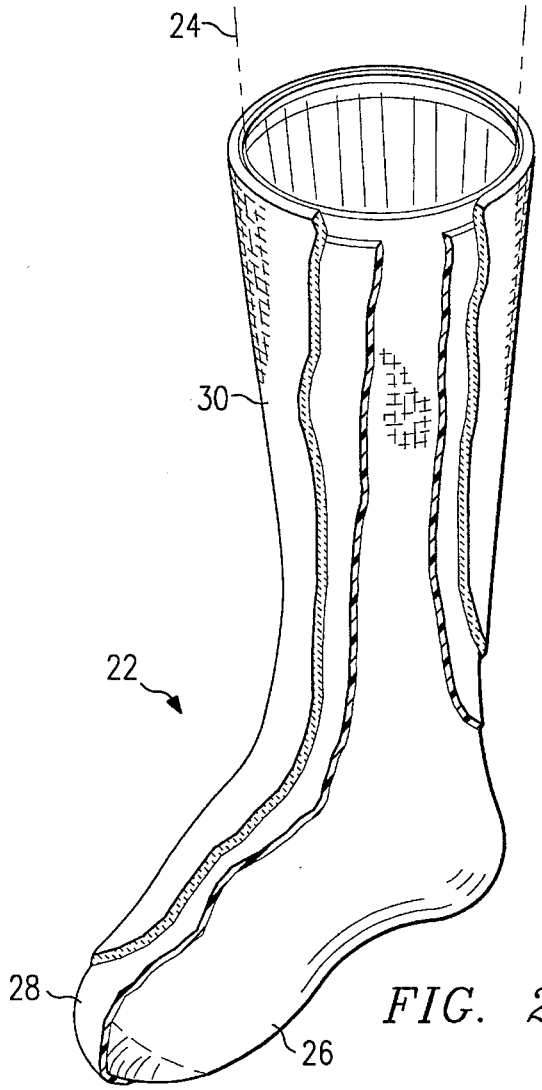
FIG. 2 is a second embodiment of low-friction footwear constructed according to the teachings of the present invention.

FIG. 2 illustrates a second embodiment of an article of footwear indicated generally at 22 constructed according to the teachings of the present invention. Footwear 22 is used to cover the foot, ankle, and lower calf of a user 24. Footwear 22 comprises an inner layer 26 which fits snugly around the calf, ankle, and foot of user 24. Inner layer 26 may be constructed identically of the same materials as inner layer 14 described previously. Footwear 22 further comprises a friction isolation layer 28 that, in the case of footwear 22, completely surrounds inner layer 26. Friction isolation layer 28 may be attached to inner layer 26 at the calf opening of footwear opening and at the toe of footwear 22. Friction isolation layer 28 may be constructed of the same materials described previously with reference to friction isolation layer 16 described with respect to FIG. 1.

Footwear 22 finally comprises an outer layer 30 that may be constructed identically as outer layer 20 described with reference to FIG. 1. Once again, outer layer 30 may be attached to friction isolation layer 28 and inner layer 26 at the calf opening of footwear 22 and at the toe of footwear 22.

Similar to the operation of footwear 10 described previously, movement of a shoe or boot worn by user 24 will cause movement of outer layer 30 of footwear 22. However, due to the positioning of friction isolation layer 28 between outer layer 30 and inner layer 26, the movement of outer layer 30 will not be translated to inner layer 26. Accordingly, the fabric adjacent to the skin of user 24 will not move thereby preventing irritation to the skin caused by the movement of a shoe or boot worn by the user 24.

According to an alternate embodiment of the present invention, the friction isolation layer may be fixed in its entirety to either the outer surface of an inner layer or to the inner surface of an outer layer. For example, with reference to FIG. 2, friction isolation layer 28 may be fixed in its entirety to the outer surface of inner layer 26. In this manner, the outer surface of inner layer 26 would be slick enough to prevent the movement of outer layer 30 from causing movement of the inner layer 26. The identical effect may be accomplished by fixing the friction isolation layer 28 to the inner surface of outer layer 30.

Additionally, the size and shape of the present low-friction insert is not limited to those depicted in the FIGUREs. For example, the present garment can be used to protect the entire leg of its user as would be beneficial when horseback riding to prevent irritation of the inner leg. Additionally, the present low-friction garment may be used to prevent irritation of a person's skin wherever repetitive motion of an article against the skin may cause skin irritation.

Although the present invention has been described in detail, it should be understood that various changes, alterations, and substitutions may be made to the teachings of the present invention without departing from the scope of the present invention, which is solely defined by the appended claims.

What is claimed is:

1. An article of clothing comprising:

a first layer of fabric;

a second layer of fabric disposed within the first layer; the second layer having an inner surface for contact with the skin of the user of the clothing; the second layer having an outer surface surrounded by the first layer; and a friction isolation layer disposed between the first layer and the second layer such that substantially all movement of the first layer is not translated to movement of the second layer relative to the skin of the user of the clothing.

2. The article of claim 1 wherein the friction isolation layer comprises a low friction material disposed between the first layer and second layer.

3. The article of claim 2 wherein the material of the friction isolation layer comprises vinyl.

4. The article of claim 2 wherein the material of the friction isolation layer comprises satin cloth.

5. The article of claim 2 wherein the material of the friction isolation layer comprises mylar.

6. The article of claim 2 wherein the material of the friction isolation layer comprises slick plastic.

7. The article of claim 2 wherein the material of the friction isolation layer comprises slick nylon.

8. The article of claim 1 wherein the friction isolation layer is formed around selected portions of a foot of the user.

9. The article of claim 8 wherein the second layer, friction isolation layer, and first layer each surround the entire foot, ankle, and lower calf of the user.

10. The article of claim 1 wherein the entirety of the friction isolation layer is fixed to the outer surface of the second layer.

11. The article of claim 1 wherein the entirety of the friction isolation layer is fixed to an inner surface of the first layer.

12. The article of claim 1 wherein the friction isolation layer is porous.

13. The article of claim 1 wherein the friction isolation layer is water resistant.

14. The article of claim 1 wherein the friction isolation layer provides thermal insulation to the user.

15. The article of claim 1 wherein the friction isolation layer is removable.

16. The article of claim 1 wherein the friction isolation layer is secured to at least one of the first and second layers.

17. An insert for use between an outer layer of fabric and an inner layer of fabric, the inner layer disposed outwardly from the skin of the user of the insert, the insert comprising:

a sheet of friction isolation material disposed between the inner and outer layer for isolating movement of the outer layer with respect to the inner layer so that substantially all movement of the outer layer is not translated to movement of the inner layer relative to the skin of the user of the article, wherein the sheet of friction isolation material is completely surrounded by the outer layer.

18. The insert of claim 17 wherein the friction isolation material comprises vinyl.

19. The insert of claim 17 wherein the friction isolation material comprises satin cloth.

20. The insert of claim 17 wherein the friction isolation material comprises mylar.

21. The insert of claim 17 wherein the friction isolation material comprises slick plastic.

22. The insert of claim 17 wherein the friction isolation material comprises slick nylon.

23. The insert of claim 17 further comprising a securing mechanism for securing the sheet to the user.

24. A method for reducing a person's skin irritation due to repetitive motion of an article against the person's skin, the method comprising:

placing a first layer of fabric outwardly from the person's skin;

placing a friction isolation surface between the first layer and the person's skin such what substantially all movement of the first layer is not translated to the person's skin, wherein the friction isolation surface is completely surrounded by the first layer; and placing a second layer of fabric between the friction isolation surface and the person's skin.

* * * * *